US006535174B2

(12) United States Patent
Rao et al.

(10) Patent No.: US 6,535,174 B2
(45) **Date of Patent: *Mar. 18, 2003**

(54) MULTI-MODE SQUARE HORN WITH CAVITY-SUPPRESSED HIGHER-ORDER MODES

(75) Inventors: Sudhakar Rao, Torrance, CA (US); Arun Bhattacharyya, El Segundo, CA (US)

(73) Assignee: Hughes Electronics Corporation, El Segundo, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/467,637

(22) Filed: Dec. 20, 1999

(65) Prior Publication Data

US 2001/0052881 A1 Dec. 20, 2001

(51) Int. Cl.[7] ..... H01Q 13/00
(52) U.S. Cl. ..... 343/786; 343/772
(58) Field of Search ..... 343/786, 772, 343/783, 776; H01Q 13/00

(56) References Cited

U.S. PATENT DOCUMENTS 3,699,583 A * 10/1972 Beguin ..... 343/756
3,701,163 A * 10/1972 Grabowski ..... 343/786
3,898,669 A * 8/1975 Blume ..... 343/786
3,906,508 A * 9/1975 Foldes ..... 343/786
4,052,724 A * 10/1977 Takeichi et al. ..... 343/786
4,058,813 A * 11/1977 Risko ..... 343/786
4,675,689 A * 6/1987 Haas et al. ..... 343/786
4,704,611 A * 11/1987 Edwards et al. ..... 342/367
4,757,326 A * 7/1988 Profera, Jr. ..... 343/786
5,305,001 A * 4/1994 Wong et al. ..... 343/786
5,617,108 A * 4/1997 Silinski et al. ..... 343/786
5,793,334 A * 8/1998 Anderson et al. ..... 343/786
5,907,309 A * 5/1999 Anderson et al. ..... 343/786
6,118,412 A * 9/2000 Chen ..... 343/756
6,137,450 A * 10/2000 Bhattachatyya et al. .... 343/786

* cited by examiner

*Primary Examiner*—Don Wong
*Assistant Examiner*—Trinh Vo Dinh
(74) *Attorney, Agent, or Firm*—Gates & Cooper LLP

(57) ABSTRACT

An antenna apparatus that has an increased efficiency, and a method for increasing the efficiency of multi-mode antenna feed horns, is disclosed. The method comprises the steps of exciting, within the antenna, a desired transmission mode and an undesired transmission mode of the signal to be transmitted, and converting, within the antenna, power within the undesired transmission mode into power for the desired transmission mode of the signal to be transmitted. An antenna apparatus in accordance with the present invention comprises a feed horn having an input opening, an aperture, and a cavity, disposed between the input opening and the aperture, for suppressing an undesired transmission mode of the antenna and exciting a desired transmission mode of the antenna.

23 Claims, 8 Drawing Sheets

MULTI-MODE SQUARE HORN WITH CAVITY-SUPPRESSED HIGHER-ORDER MODES

BACKGROUND OF THE INVENTION

1. Field of the Invention

This invention relates in general to antennas, and, in particular, to a multi-mode square horn antenna with cavity suppressed higher order modes.

2. Description of Related Art

Communications satellites are in widespread use. The communications satellites are used to deliver television and communications signals around the earth for public, private, and military uses.

The primary design constraints for communications satellites are antenna beam coverage and radiated Radio Frequency (RF) power. These two design constraints are typically thought of to be paramount in the satellite design because they determine which customers on the earth will be able to receive satellite communications service. Further, the satellite weight becomes a factor, because launch vehicles are limited as to how much weight can be placed into orbit.

Many satellites operate over fixed coverage regions that are geographically limited by the beam coverage and available RF power. The inefficiencies of RF systems, losses due to cabling, and other system constraints limit the available power for the overall system, and, as such, limit the signal strength that is available for communication links. As such, to provide a stable, reliable communications link, the geographic area that is serviced by the satellite must be limited.

Many satellite systems would be more efficient if they contained feed horns that have higher gain or more efficient feed horn systems. However, related art feed horns that have increased efficiency are larger and heavier than standard antennas, and, as such, require larger payload volumes. Further, the increased weight increases launch costs.

There is therefore a need in the art for increased efficiency antenna systems. There is also a need in the art for antenna systems that have increased efficiency feed horns that are of comparable size and weight. There is also a need in the art for antenna systems that provide more complete utilization of space assets without dramatically increasing the cost of manufacturing and operating a satellite. There is also a need in the art for antenna elements in array applications having higher element efficiency such that the number of elements can be reduced. A reduction in the number of elements in an array antenna application reduces the number of feed components and amplifiers, lowers the mass of the system, and reduces cost and antenna complexity.

SUMMARY OF THE INVENTION

To overcome the limitations in the prior art described above, and to overcome other limitations that will become apparent upon reading and understanding the present specification, the present invention discloses an antenna apparatus that has an increased efficiency, and a method for increasing the efficiency of multi-mode antenna feed horns.

The method comprises the steps of exciting, within the antenna, a desired transmission mode and an undesired transmission mode of the signal to be transmitted, and converting, within the antenna, power within the undesired transmission mode into power for the desired transmission mode of the signal to be transmitted. An antenna apparatus in accordance with the present invention comprises a feed horn having an input opening, an aperture, and a cavity, disposed between the input opening and the aperture, for suppressing an undesired transmission mode of the antenna and exciting a desired transmission mode of the antenna.

An antenna in accordance with the present invention provides an increased efficiency antenna system. An antenna in accordance with the present invention also provides an antenna system that has increased efficiency feed horns that are of comparable size and weight. An antenna in accordance with the present invention also provides antenna array systems that provide more complete utilization of space assets without dramatically increasing the cost of manufacturing and operating a satellite. Further, an antenna in accordance with the present invention provides antenna elements in array applications that have higher element efficiency such that the number of elements can be reduced.

BRIEF DESCRIPTION OF THE DRAWINGS

Referring now to the drawings in which like reference numbers represent corresponding parts throughout.

DETAILED DESCRIPTION OF THE PREFERRED EMBODIMENT

In the following description of the preferred embodiment, reference is made to the accompanying drawings that form a part hereof, and in which is shown by way of illustration a specific embodiment in which the invention may be practiced. It is to be understood that other embodiments may be utilized and structural changes may be made without departing from the scope of the present invention.

Overview

Many satellites operate over fixed coverage regions that are geographically limited by the beam coverage and available RF power. The inefficiencies of RF systems, losses due to cabling, and other system limitations limit the available power for the overall system, and, as such, limit the signal strength that is available for communication links. As such, to provide a stable, reliable communications link, the geographic area that is serviced by the satellite must be limited.

Many satellite systems would be more efficient if they contained feed horns that are smaller and more efficient.

However, related art feed horns that have increased gain are larger and heavier than standard antennas, and, as such, require larger payload volumes. Further, the increased weight increases launch costs.

The present invention describes a high efficiency multi-mode square horn suitable as a radiating element for array as well as reflector antennas. The horn of the present invention can be used in communication satellites as well as other antenna applications. The horn is over 90 percent efficient and can handle dual polarizations, e.g., vertical/horizontal or left-hand circular/right-hand circular polarizations.

The present invention uses a cavity in order to suppress unwanted modes of the radiated signal. Typically, for the dominant Transverse Electric (TE) $TE_{10}$ and $TE_{01}$ mode input square waveguide, the unwanted modes are the Transverse Electric (TE)12 and the Transverse Magnetic (TM)12 modes. The power in the unwanted modes is redirected or converted into desired higher order radiation modes, typically the $TE_{30}$ and $TE_{03}$ modes, which, in addition to the dominant $TE_{10}$ and $TE_{01}$ modes, produces a more uniform illumination in the H-plane of the antenna. This more uniform illumination in the H-plane produces a higher efficiency horn.

Cavity Description

Figure 1:
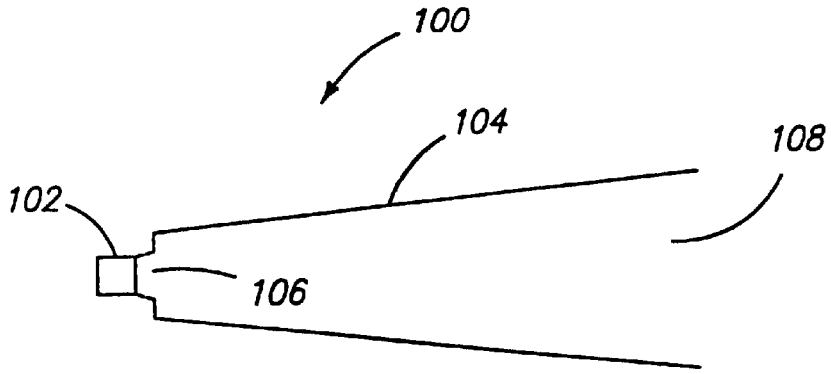
FIG. 1 Prior Art
FIG. 1 illustrates a side view of a feed horn of the related art.

FIG. 1 illustrates a side view of a feed horn of the related art. Feed horn 100 typically consists of a radiative chamber 102 and antenna walls. Radiative chamber 102 is typically the open end of a piece of waveguide, but can be integral to the antenna for connection to an RF system via cables if desired. The radiative chamber 102 attaches to antenna walls 104 at opening 106. The antenna walls 104 confine the radiation generated in the radiative chamber 102 and direct the radiation in a certain direction. The antenna walls 104 form a pyramidal shape, and, as such, feed horn 100 is typically called a pyramidal horn 100.

Pyramidal horns 100 are commonly used as radiating elements in phased array antennas or as feeds for shaped reflector antennas for communication satellites. Pyramidal horns radiate electromagnetic radiation in the $TE_{10}$ mode. Typical sizes of these pyramidal horns 100 are in the range of 1.8 wavelengths to about 4.0 wavelengths, e.g., at a frequency of 8 gigahertz, the wavelength is approximately 3.75 centimeters (cm), which places the length of the pyramidal horn between 6.75 cm and 15 cm. For such large antenna horn sizes, pyramidal horns 100 suffer from large phase errors across the aperture 108 and have a tapered aperture 108 illumination in the H-plane. As a result of these two effects, efficiency of these pyramidal horns 100 is typically in the range of 75% to 80%, and suffers from the disadvantage of large axial length.

Figure 2:
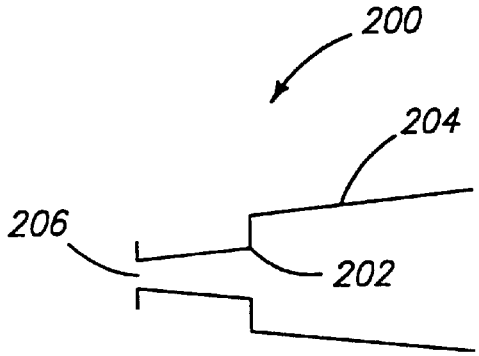
FIG. 2 Prior Art
FIG. 2 illustrates a step horn of the related art.

FIG. 2 illustrates a step horn of the related art. The efficiency of a typical pyramidal feed horn can be improved to about 85% by introducing the $TE_{30}$ mode in addition to the dominant $TE_{10}$ mode of pyramidal horn 100. Step horn 200 uses a step junction 202 in antenna walls 204 to produce another radiative mode, the $TE_{30}$ mode, from signals that emanate from opening 206. However, step junction 202 also produces other modes of the signal, e.g., the unwanted $TE_{12}$ and $TM_{12}$ modes that limit the efficiency of the step horn 200. The axial length of the step horn 200 is typically shorter than a comparable pyramidal horn 100.

Figure 3:
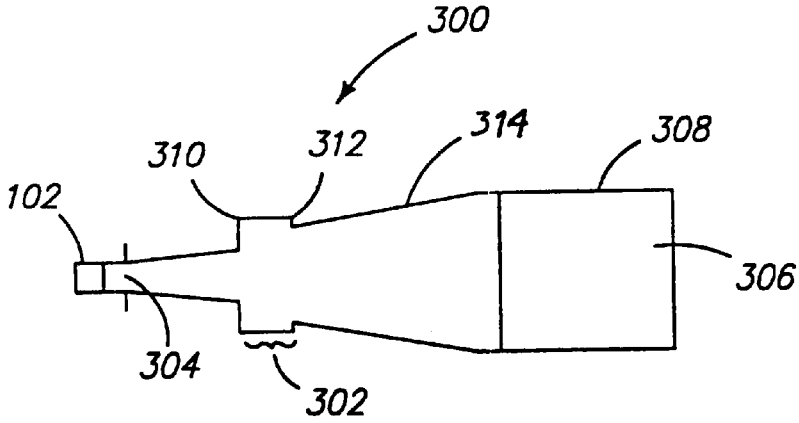
FIG. 3 illustrates the cavity feed horn of the present invention.

FIG. 3 illustrates one embodiment of the cavity feed horn of the present invention. The present invention is a cavity feed horn 300 having a cavity 302 disposed between the opening 304 and aperture 306 of cavity feed horn 300 to suppress the unwanted $TE_{12}$ and $TM_{12}$ transmission modes. Cavity 302 also converts the power in the unwanted $TE_{12}$ and $TM_{12}$ modes to the desired $TE_{10}$ and $TE_{30}$ modes to improve the efficiency of the cavity feed horn 300. The cavity 302 makes the aperture 306 illumination more uniform and increases the efficiency to about 92%. Aperture 306 outline 308, which is the longitudinal cross-section of the cavity feed horn 300, remains substantially square in nature. The cavity feed horn 300 is approximately 12% more efficient than pyramidal horn 100 and 6% more efficient than step horn 200.

This increase in the horn 300 efficiency can be used to reduce the number of horn 300 elements in an antenna array to achieve similar performance as an array using pyramidal horns 100, or to reduce the RF power needed to excite a feed horn 300, or an array of feed horns 300, as opposed to a pyramidal horn 100, or an array of pyramidal horns 100, by approximately 12% to 17%. This reduction in the number of horns 300 required reduces the weight and required power of the antenna system, and therefore reduces the cost of manufacture and operation. Further, reduction in the RF power required to complete the communications link reduces the weight of power supplies needed on the satellite, thereby reducing the cost and weight of the spacecraft.

Cavity feed horn 300 typically has a four-fold symmetry, as shown in outline 308, and incorporates two steps 310 and 312 in two opposite directions, forming a cavity 302. Cavity 302 is typically formed equidistant from opening 304 and aperture 306, but can be formed anywhere between opening 304 and aperture 306 as desired. The cavity 302 excites desired modes of transmission and suppresses the unwanted modes of transmission and thereby increases the efficiency of the cavity feed horn 300, also called a multi-mode square horn, to about 92%.

Although described with respect to the desired modes of $TE_{10}$ and $TE_{30}$, and the undesired modes of $TE_{12}$ and $TM_{12}$, any transmission mode can be excited or suppressed using cavity 302.

The present invention also allows array antennas to utilize dual polarizations, e.g., dual-linear or dual-circular polarizations, because the aperture 306 outline 308 is square. Square outlines 308 are desirable because the cavity feed horn 300 input (opening 304) can couple directly to the square waveguide 102 carrying a circularly polarized signal. Further the square apertures 306 maximize the array aperture area because no inter-element gap exists between adjacent cavity feed horns 300. If aperture 306 were circular, interstitial sites would exist between the cavity feed horns 300.

Advantages of the Present Invention

Figure 4A:
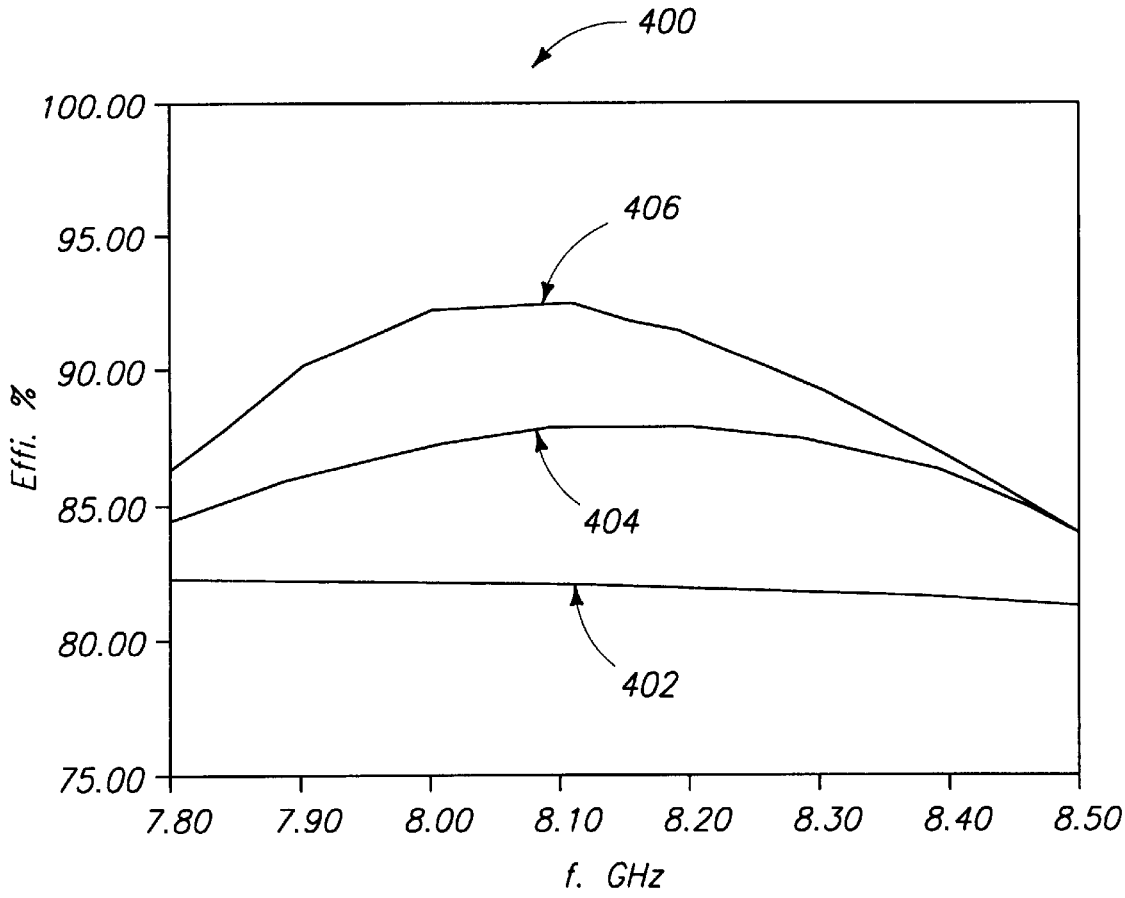
FIG. 4A illustrates the radiation efficiency of the feed horn of the present invention compared to the related art.

FIG. 4A illustrates the radiation efficiency 400 of the feed horn of the present invention compared to the related art. In order to minimize the number of feed horns in an array, the feed horns should have high radiation efficiency. The typical radiation efficiency, in the X-band frequency range, of a large pyramidal horn 100 is about 80%, as shown by graph 402. The radiation efficiency of a H-plane step horn 200 with a rectangular input that supports the $TE_{10}$mode and does not support the $TE_{01}$ mode is about 84% to 86%, as shown by graph 404.

However, a rectangular input cannot be used for dual-linear or dual-circular polarization applications, as described above. For good circular polarization with minimum cross-polar power near the boresight direction, the horn advantageously has a four-fold symmetry, as provided by a square outline 308. A square outline 308 also makes the cavity feed horn 300 directly compatible with waveguide 310, which provides the signal to be transmitted by the cavity feed horn 300. To comply with the above requirements and to increase the efficiency of a square horn, steps 202 must be made in all four walls 204 in order to generate the $TE_{30}$ and $TE_{03}$ modes.

$TM_{12}$ modes that have lower cutoff frequencies than that of the $TE_{30}$ mode. These two modes taper the aperture distribution which effectively reduce the radiation efficiency, as shown in graph 404.

The intensity of the undesired radiation modes is suppressed in the present invention by adding a second step 312 discontinuity in an appropriate location so as to create a cavity 302, as described with respect to FIG. 3. A typical step horn 200 with highest possible efficiency will have a total power carried by the $TE_{10}$, $TE_{30}$, $TE_{12}/TM_{12}$ modes of 95.9%, 1.6%, and 2.5% respectively. With the second step 312 added in an appropriate location as in the cavity feed horn 300 of the present invention, the total power carried by the $TE_{10}$, $TE_{30}$ and $TE_{12}$ become 94.6%, 4.2%, and 1.2% respectively. For an ideal situation of a dual mode horn, the total power carried by the $TE_{10}$, $TE_{30}$ and $TE_{12}$ become 94.3%, 5.7%, and 0.0%, respectively. The second step 312 of the present invention brings the modal power ratio closer to the ideal limit.

As a result of the cavity 302 introduced in the cavity feed horn 300, the cavity feed horn 300 efficiency is increased to about 91%, as shown in graph 406. The graph 406 illustrates a 6% increase in the cavity feed horn 300 efficiency compared to a step horn 200, and a 12% increase compared to a pyramidal horn 100. The cavity feed horn 300, when used in an array, enables a designer to reduce the number of elements (feed horns) in the array by about 6% to 12% compared to designs using step horns 200 or pyramidal horns 100, resulting in significant cost and mass savings.

The present invention takes advantage of the guide wavelength differences between the different transmission modes to selectively suppress the undesired transmission modes. In the present invention, the first step 310 discontinuity generates the $TE_{30}$, $TE_{12}$, and $TM_{12}$ modes. Immediately after the first step 310 discontinuity, the $TE_{10}$, $TE_{12}$, and the $TE_{30}$ modal fields are in phase, the phase-reference point being located on the axis of the cavity feed horn 300. This phase relationship ensures the continuity of the electric fields at both sides of the step 310 discontinuity.

At the second step 312 discontinuity, the $TE_{10}$ and $TE_{30}$ transmission modes are out of phase, because the aperture opening abruptly reduces. If the distance between step 310 and step 312 is chosen properly, e.g., the length of cavity 302 is selected to be one-half of the guide wavelength of the $TE_{12}/TE_{10}$ modes, then the $TE_{30}$ mode created by the $TE_{10}$ mode and the two discontinuities will be added substantially in-phase, and the $TE_{12}/TM_{12}$ signals add out-of-phase at the second step 312 discontinuity. As a result, the unwanted mode content due to the $TE_{12}/TM_{12}$ modes is reduced while the desired TE30 mode content is enhanced.

The desired $TE_{10}$ and undesired $TE_{12}$ transmission modes arrive at the second step 312 discontinuity substantially in phase because these two desired transmission modes have almost equal phase velocities. These two modes jointly produce the $TE_{10}$ transmission mode after the second step 312 discontinuity with a minimum amount of the $TE_{12}$ mode, which is the opposite effect of the first discontinuity. Thus, after the second step 312 discontinuity, the desired $TE_{30}$ transmission mode is intensified and the undesired $TE_{12}$ transmission mode is suppressed by converting power in the undesired mode to power in the desired mode. Other forms of suppression, such as elimination of transmission, reflection, or other means are also possible using the step 312 of the present invention. By transferring power from undesired transmission modes to desired transmission modes, the efficiency of the cavity feed horn 300 is increased.

A preferred embodiment of cavity feed horn 300 operates at X-band, which is between 7.8 and 8.5 gigahertz. The preferred embodiment has cavity 302 placed substantially halfway between input opening 304 and aperture 306. Cavity 302 is typically five centimeters in length, which is approximately one-half guide wavelength for the $TE_{12}$ transmission mode. The aperture 306 has sides of 2.75 inches in length, and is substantially square. Other embodiments are possible within the operational frequency band, which will excite certain desired transmission modes and suppress certain other undesired transmission modes. Further, cavity feed horn can be designed to operate at other frequency bands, such as C-band, Ku-band, Ka-band, or other frequency bands by utilizing proper size and length relationships for the cavity feed horn 300.

Although shown as having a cavity 302 that extends completely around the perimeter of cavity feed horn 300, cavity 302 can take other shapes. For example, cavity 302 can exist on one face of the cavity feed horn 300, two faces of the cavity feed horn 300, two opposing faces of the cavity feed horn 300, or three faces of the cavity feed horn 300. Cavity 302 may only exist on parts of one or more of the faces of cavity feed horn 300 as well. More than one cavity 302 may be used to excite and suppress transmission modes as desired.

The cross section of cavity 302 is shown as rectangular, but can take other shapes such as triangular, sawtooth, square, round, piecewise linear, or other shapes to excite and suppress the transmission modes desired for cavity feed horn 300. Further, although shown as a cavity 302 that extends away from the walls of the cavity feed horn 300, a change in the wall shape that extends into the opening of the cavity feed horn can provide the same advantages as cavity 302. As such, cavity 302, when used herein, refers not only to an enlargement of the cross section of the cavity feed horn 300, but also refers to a reduction or other change in the cross-section of the cavity feed horn 300 that differs from the angular dimensions of the cavity feed horn 300.

FIGS. 4B–4G illustrate alternative embodiments of the cavity feed horn of the present invention.

Figure 4B:
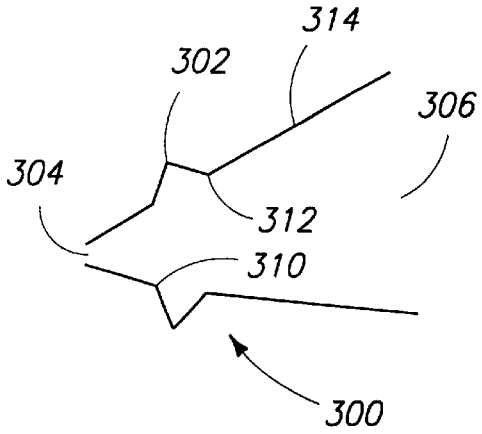
FIGS. 4B–4G illustrate alternative embodiments of the cavity feed horn of the present invention.

FIG. 4B illustrates cavity 302 having a triangular cross section, and cavity 302 is not symmetrical about an axis of the cavity feed horn 300. Walls 314 define the aperture 306 and the input opening 302 of the cavity feed horn 300. Walls 314, however, are not required to define cavity 302 symmetrically about the axis of cavity feed horn 300.

Figure 4C:
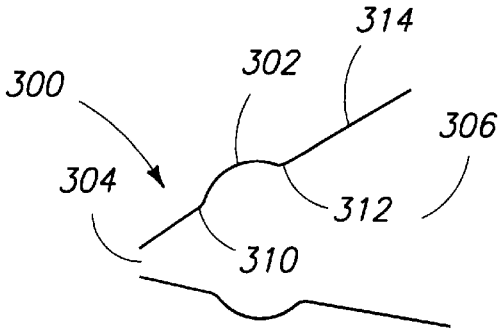
Figure 4D:
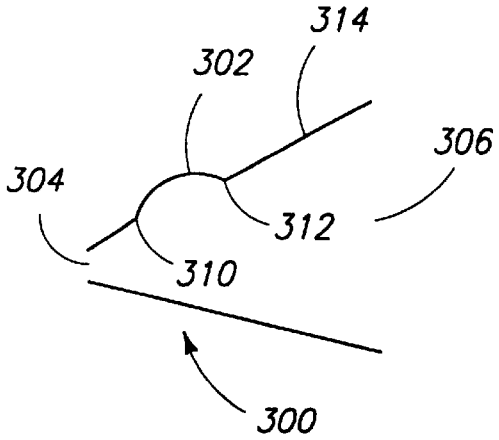
Figure 4E:
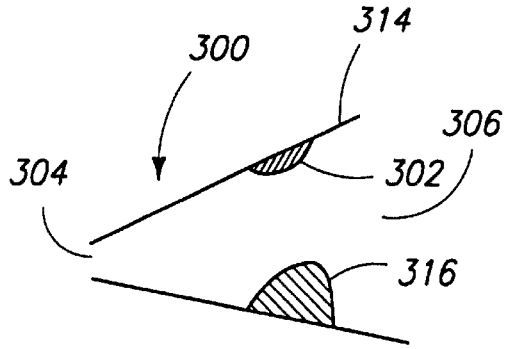
Figure 4F:
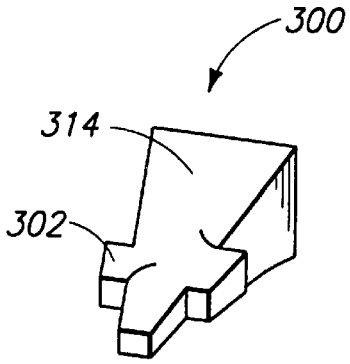
Figure 4G:
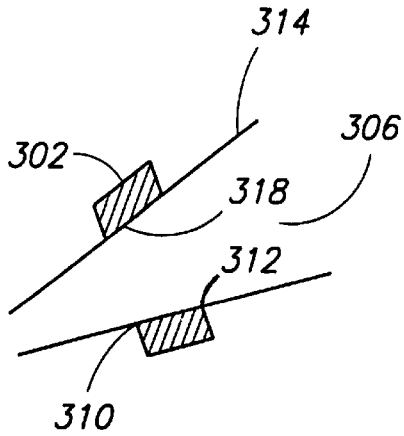

FIG. 4C illustrates cavity 302 having a curved cross section. Although aperture 306 is typically square in cross section, cavity 302 is not limited to having a square cross section. First step 310 and second step 312, as shown in FIG. 4C, can be rounded as well as creating a discontinuity. FIG. 4D illustrates cavity 302 having an asymmetrical aspect about an axis of cavity feed horn 300. FIG. 4E illustrates that cavity 302 can reside within walls 314 instead of extending away from a centerline of cavity feed horn 300. Further, cavity 302 and cavity 316 can be asymmetrical, as well as placed at different distances from aperture 306 and input opening 304. FIG. 4F illustrates that cavity 302 can be substantially oppositely opposed without substantially circumscribing cavity feed horn 300. FIG. 4G illustrates that cavity 302 can be filled with material 318 or partially filled with material 318.

Transmission and Reflection Characteristics

Figure 5A:
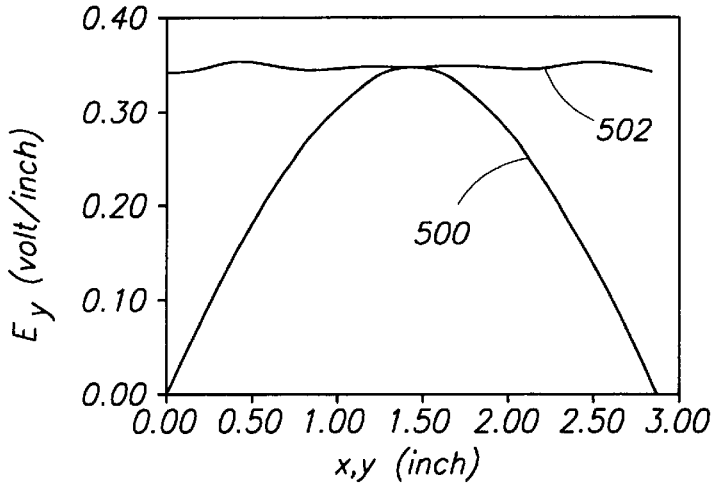
FIGS. 5A–5C illustrate the aperture field distributions for various designs of feed horns, including the feed horn of the present invention.
Figure 5B:
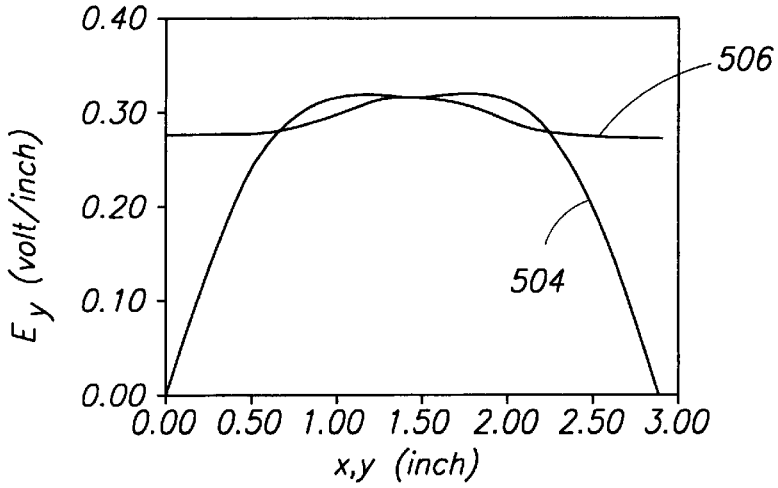
Figure 5C:
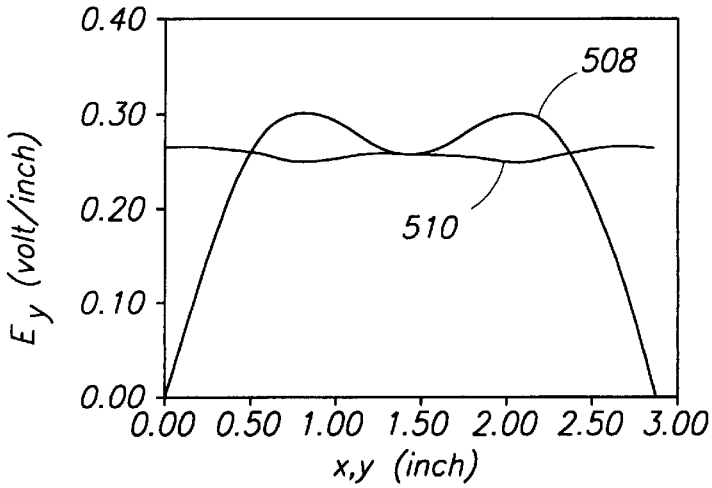

FIGS. 5A–5C illustrate the aperture field distributions for various designs of feed horns, including the feed horn of the present invention.

FIG. 5A illustrates the uniformity of the field as measured in the normal and parallel planes of a pyramidal horn 100. Graph 500 illustrates the normal field distribution, and graph 502 illustrates the parallel field distribution.

FIG. 5B illustrates the uniformity of the field as measured in the normal and parallel planes of a step horn 200. Graph 504 illustrates the normal field distribution, and graph 506 illustrates the parallel field distribution.

FIG. 5C illustrates the uniformity of the field as measured in the normal and parallel planes of the cavity feed horn 300 of the present invention. Graph 508 illustrates the normal field distribution, and graph 510 illustrates the parallel field distribution. The cavity feed horn 300 has more aperture uniformity compared to pyramidal horn 100 and step horn 200, but broadens the peak of the field strength in the normal direction as shown in graph 508.

Figure 6:
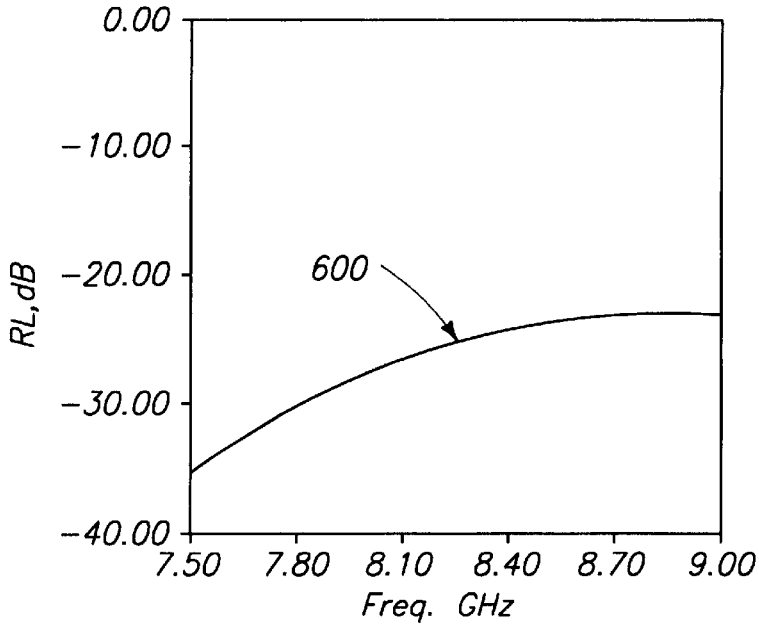
FIG. 6 illustrates the return loss performance of a cavity feed horn of the present invention.

FIG. 6 illustrates the return loss performance of a cavity feed horn of the present invention. The return loss 600 is better than 25 dB over the 7% bandwidth.

Figure 7:
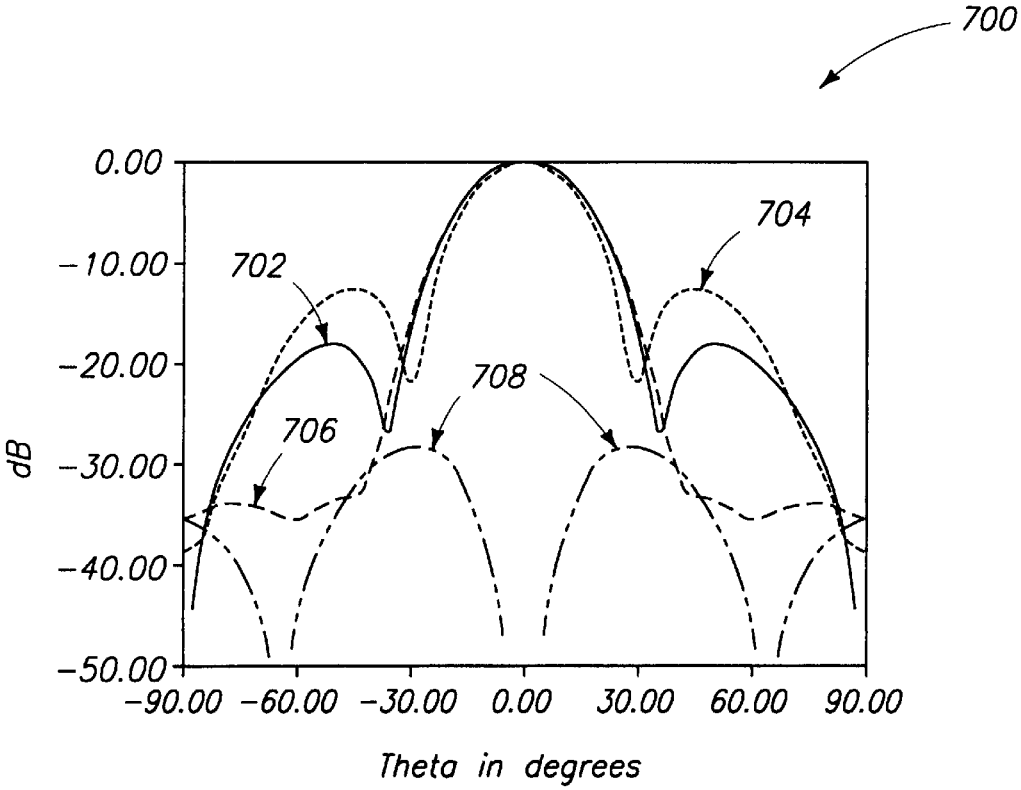
FIG. 7 illustrates typical radiation patterns of a cavity feed horn of the present invention.

FIG. 7 illustrates typical radiation patterns of a cavity feed horn of the present invention.

The transmission patterns 700 of cavity feed horn 300 are shown at a single frequency, typically a center frequency of the cavity feed horn 300. As discussed above, this frequency is typically 8.2 gigahertz. H-plane performance is shown in graph 702, and E-plane performance is shown in graph 704. The 45-degree transmission pattern is shown in graph 706, and the cross-polar levels are shown in graph 708. The cross-polar levels of graph 708 are 30 dB below the peak of the copolar peaks of graphs 702, 704, and 706.

Figure 8A:
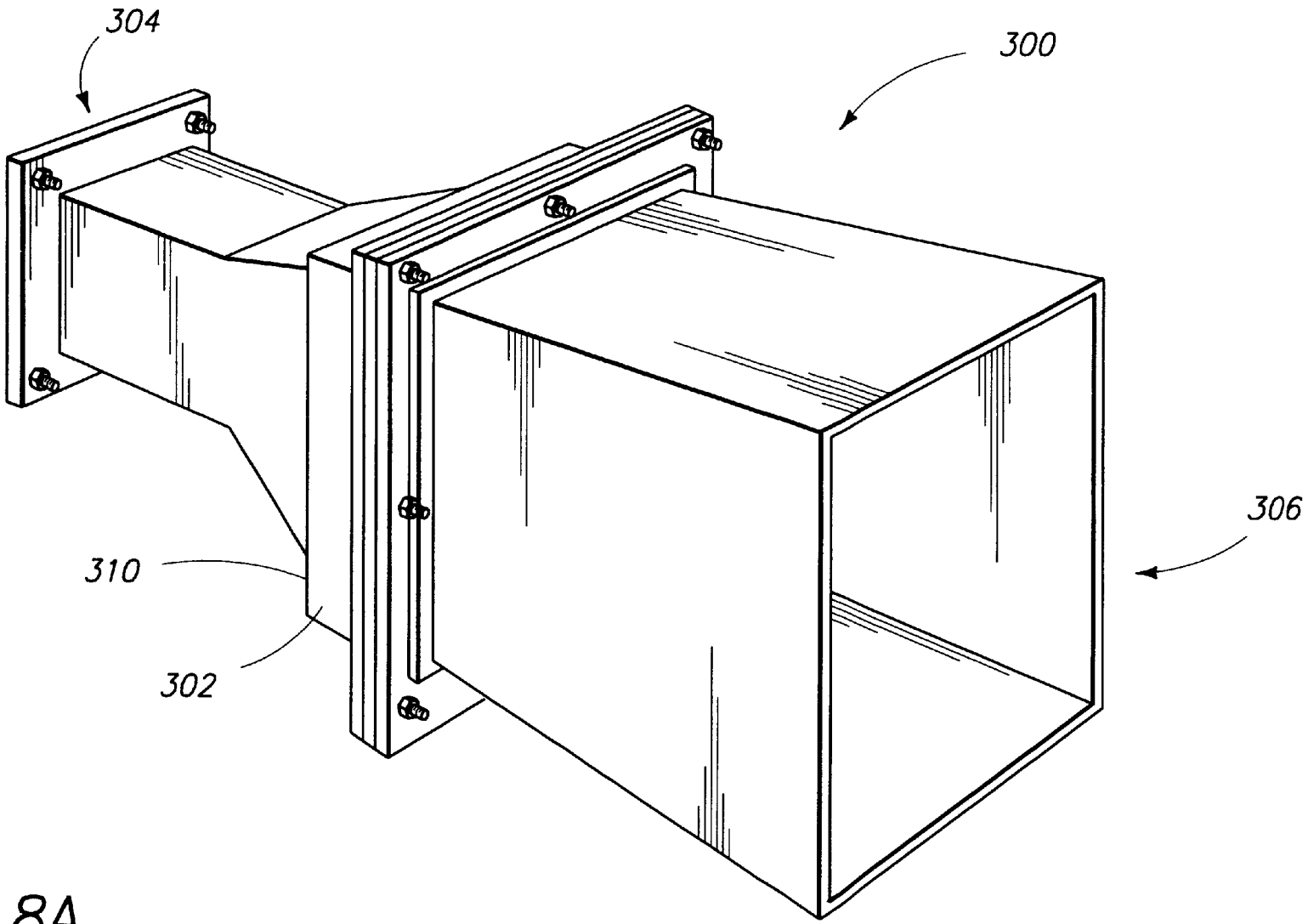
FIG. 8A illustrates an isometric view of the cavity feed horn of the present invention.

FIG. 8A illustrates an isometric view of the cavity feed horn of the present invention. The steps 310 and 312 and aperture 306 are indicated.

Figure 8B:
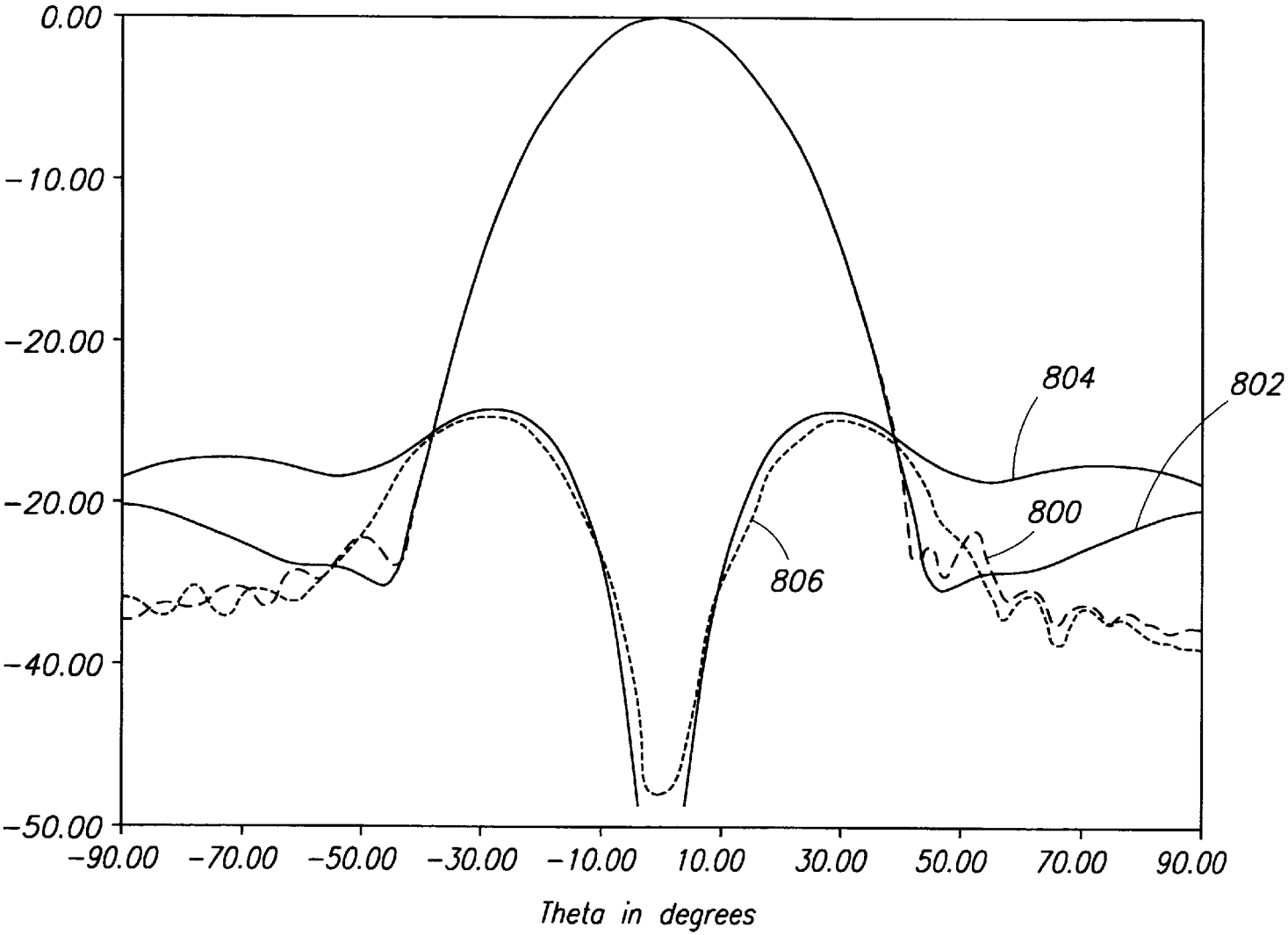
FIG. 8B illustrates the comparison between the measured and computed radiation patterns of the cavity feed horn of the present invention.

FIG. 8B illustrates the comparison between the measured and computed radiation patterns of the cavity feed horn of the present invention. Measured pattern 800 and computed pattern 802 in the 45 degree plane are shown. The measured pattern 800 agrees well with computed pattern 802. The efficiency of cavity feed horn 300 is measured at 95%. Cross-polarization computed pattern 804 and measured pattern 806 are also indicated.

Figure 9:
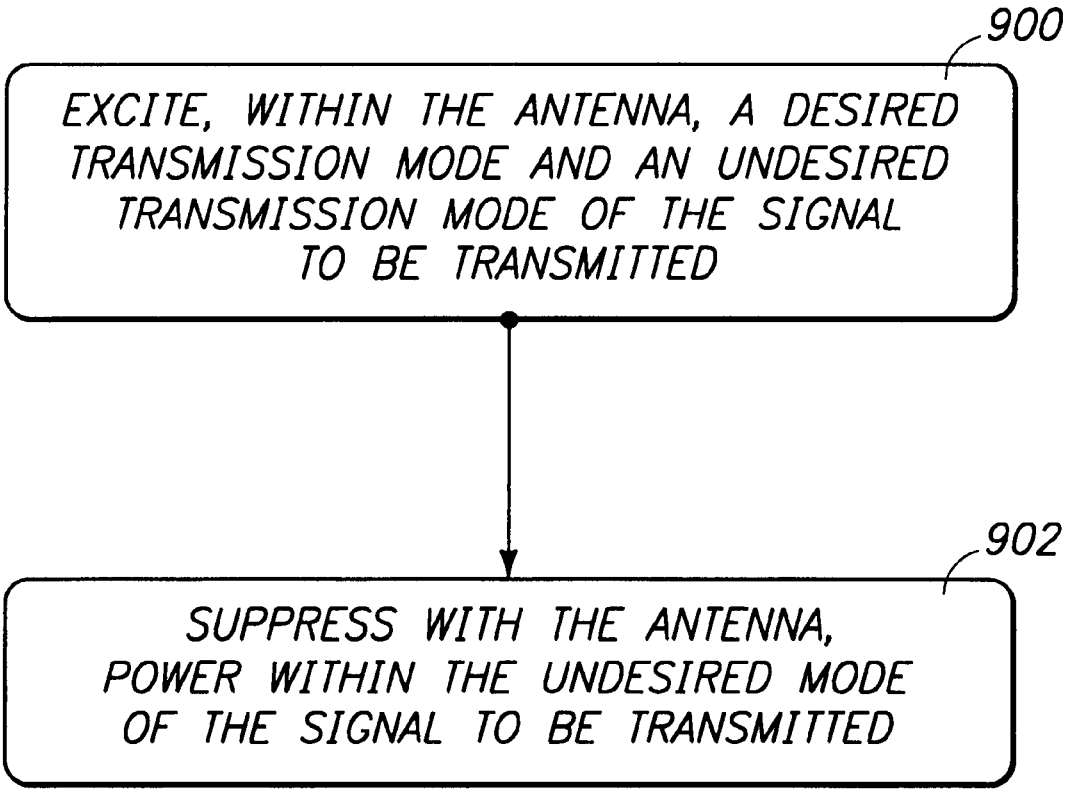
FIG. 9 is a flow chart illustrating the steps used in practicing one embodiment of the present invention.

FIG. 9 is a flowchart illustrating the steps used to practice one embodiment of the present invention.

Block 900 illustrates the step of exciting, within the antenna, a desired transmission mode and an undesired transmission mode of the signal to be transmitted.

Block 902 illustrates the present invention performing the step of suppressing, within the antenna, power within the undesired transmission mode.

Summary

The following paragraphs describe some alternative methods of accomplishing the same objects and some additional advantages for the present invention.

The techniques described in the present invention can be used for multiple antennas in arrays or other multiple antenna configurations. Further, the feed horns can be combined with various reflectors and reflective surfaces to modify the beam patterns and other system characteristics of a system employing the feed horn of the present invention.

Although described with respect to the desired $TE_{10}$ and $TE_{30}$ modes, and undesired $TE_{12}$ and $TM_{12}$ transmission modes, cavity 302 can be designed such that other modes can be excited or suppressed by cavity 302 as desired. This can be accomplished by changing the shape of the cavity 302, or by placing cavity 302 at a different location between the aperture 306 and the input opening 304.

The present invention can be used with many satellite payloads and is not limited by frequency band. For example, fixed and broadcast satellite services at Ku-band and C-band and personal communication satellites at Ka-band can all benefit from implementation of the present invention. Further, the present invention is applicable to direct radiating array antennas that produce multiple shaped beams or spot beams for specific applications.

In summary, the present invention provides an antenna apparatus that has an increased efficiency, and a method for increasing the efficiency of multi-mode antenna feed horns. The method comprises the steps of exciting, within the antenna, a desired transmission mode and an undesired transmission mode of the signal to be transmitted, and converting, within the antenna, power within the undesired transmission mode into power for the desired transmission mode of the signal to be transmitted.

An antenna apparatus in accordance with the present invention comprises a feed horn having an input opening, an aperture, and a cavity, disposed between the input opening and the aperture, for suppressing an undesired transmission mode of the antenna and exciting a desired transmission mode of the antenna.

The foregoing description of the preferred embodiment of the invention has been presented for the purposes of illustration and description and is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. An antenna, comprising:

a feed horn having at least one wall, an input opening and an aperture, wherein the aperture is larger than the input opening and the feed horn has a cross section increasing continuously from the input opening to the aperture; and a cavity, having a single opening and the single opening facing a closed end, the cavity disposed on the at least one wall, between the input opening and the aperture and away from the input opening where the cross section is greater than the input opening and less than the aperture, for suppressing an undesired transmission mode of the antenna and exciting a desired transmission mode of the antenna.

2. The antenna of claim 1, wherein the cavity is disposed substantially halfway between the input opening and the aperture.

3. The antenna of claim 1, wherein the aperture cross section is substantially square.

4. The antenna of claim 1, wherein the desired transmission mode comprises a $TE_{10}$ and a $TE_{30}$ modes.

5. The antenna of claim 1, wherein the undesired transmission mode comprises a $TE_{12}$ and a $TM_{12}$ modes.

6. The antenna of claim 1, further comprising a waveguide, coupled to the input opening, for providing a signal to the antenna.

7. The antenna of claim 1, wherein the cavity suppresses the undesired transmission mode by converting power from the undesired transmission mode into power for the desired transmission mode.

8. The antenna of claim 1, wherein the cavity extends substantially around the interior of the feed horn.

9. The antenna of claim 1, wherein a cross section of the cavity is selected as one of a group comprising square, rectangular, sawtooth, curved, and piecewise linear.

10. The antenna of claim 1, wherein the feed horn further includes opposing walls and the cavity resides on the opposing walls of the feed horn.

11. The antenna of claim 1, wherein the antenna operates at a frequency substantially between 7.8 and 8.5 gigahertz, and a length of the cavity is substantially five centimeters.

12. The antenna of claim 11, wherein a center of the cavity is positioned three centimeters distant from the input opening and three centimeters distant from the aperture.

13. The antenna of claim 12, wherein a cross section of the cavity is substantially rectangular.

14. The antenna of claim 1, wherein a cross section of the cavity is asymmetrical.

15. The antenna of claim 1, wherein the cavity includes a first step discontinuity and a second step discontinuity transferring power from undesired transmission modes to desired transition modes.

16. The antenna, comprising:

a feed horn having at least one wall, an input opening and an aperture, wherein the aperture is larger than the input opening and the feed horn has a cross section increasing continuously from the input opening to the aperture; and a cavity, having a single opening and the single opening facing a closed end, the cavity disposed on the at least one wall about an interior of the feed horn between the input opening and the aperture and away from the input opening where the cross section is greater than the input opening and less than the aperture.

17. A method for transmitting a signal from an antenna, comprising the steps of:

exciting, within the antenna, a desired transmission mode and an undesired transmission mode of the signal to be transmitted; and suppressing within the antenna, power within the undesired transmission mode;

wherein the exciting and suppressing are performed by a feed horn having at least one wall, an input opening and an aperture and a cavity, having a single opening and the single opening facing a closed end, the cavity disposed on the at least one wall, between the input opening and the aperture and away from the input opening where a cross section of the feed horn is greater than the input opening and less than the aperture and the aperture is larger than the input opening and the cross section of the feed horn increases continuously from the input opening to the aperture.

18. The method of claim 17, wherein the step of suppressing comprises the step of converting power from the undesired transmission mode into power for the desired transmission mode.

19. The method of claim 17, wherein the desired transmission mode comprises the $TE_{10}$ and $TE_{30}$ modes.

20. The method of claim 17, wherein the undesired transmission mode comprises $TE_{12}$ and $TM_{12}$ modes.

21. The method of claim 17, wherein the step of exciting is performed by a first step discontinuity within the antenna.

22. The method of claim 17, wherein the step of converting is performed by a step discontinuity within the antenna.

23. A signal to be transmitted by an antenna, formed by performing the steps of:

exciting, within the antenna, a desired transmission mode and an undesired transmission mode of the signal to be transmitted; and suppressing, within the antenna, power within the undesired transmission mode;

wherein die exciting and suppressing are perforated by a feed horn having at least one wall, an input opening and an aperture and away from the input opening where a cross section of the feed horn is greater than the input opening and less than the aperture and a cavity, having a single opening and the single opening facing a closed end, the cavity disposed on the at least one wall, between the input open and the aperture and the aperture is larger than the input opening and the cross section of the feed horn increases continuously from the input opening to the aperture.

* * * * *